United States Patent [19]

Traczyk et al.

[11] Patent Number: 4,696,622

[45] Date of Patent: Sep. 29, 1987

[54] ULTRASONIC CHANNEL DIFFUSER

[75] Inventors: Jan Traczyk; Jacek Brejnak; Krzysztof Kawalec, all of Warsaw, Poland

[73] Assignee: Instytut Lotnictwa, Warsaw, Poland

[21] Appl. No.: 701,088

[22] Filed: Feb. 13, 1985

[30] Foreign Application Priority Data

Mar. 27, 1984 [PL] Poland ..... 246883

[51] Int. Cl.[4] ..... F04D 29/44

[52] U.S. Cl. ..... 415/211; 415/181

[58] Field of Search ..... 415/204, 206, 207, 210, 415/211, 181, 208, 209

[56] References Cited

U.S. PATENT DOCUMENTS

| | | | |
|---|---|---|---|
| 3,333,762 | 8/1967 | Vrana | 415/211 |
| 3,604,818 | 9/1971 | Cronstedt | 415/211 |
| 3,765,792 | 10/1973 | Exley | 415/211 |
| 3,778,186 | 12/1973 | Bandukwalla | 415/211 |
| 3,873,232 | 3/1975 | Stein et al. | 415/211 |
| 3,905,721 | 9/1975 | Fitzpatrick | 415/207 |
| 3,964,837 | 6/1976 | Exley | 415/211 |
| 4,012,166 | 3/1977 | Kaesser et al. | 415/211 |
| 4,164,845 | 8/1979 | Exley et al. | 415/211 |
| 4,395,197 | 7/1983 | Yoshinaga et al. | 415/211 |
| 4,421,457 | 12/1983 | Yoshinaga et al. | 415/211 |

FOREIGN PATENT DOCUMENTS

| | | | |
|---|---|---|---|
| 2428969 | 1/1975 | Fed. Rep. of Germany | 415/211 |
| 15797 | 1/1983 | Japan | 415/211 |
| 7909135 | 7/1981 | Netherlands | 415/211 |

*Primary Examiner*—Robert E. Garrett
*Assistant Examiner*—John Kwon
*Attorney, Agent, or Firm*—Ladas & Parry

[57] ABSTRACT

This invention solves the problem of obtaining of a higly-efficient ultrasonic diffuser.

An ultrasonic diffuser according to this invention consisting of a ring with equally spaced channels shaped by inter-channel walls permanently connected to at least one side wall of the diffuser is characteristic in that on the inlet side of the diffuser there are inter-channel walls (3) converging (S1, S2, S3 and S4) towards the axis of the diffuser ring (1), and that, on the side of the inside diameter, the diffuser has removable side walls (6 and 7) which can be provided with sharply terminated partial vanes (8).

3 Claims, 4 Drawing Figures

ULTRASONIC CHANNEL DIFFUSER

BACKGROUND OF THE INVENTION

This invention relates to an ultrasonic channel diffuser, particularly a radial one, and to a method of manufacture of such ultrasonic diffuser, particularly a radial one, applicable in the construction of the flow compressors of all kinds, particularly ultrasonic ones.

Those skilled in art know channel diffusers produced by making suitable channels of a circular cross section in a cylindrical ring (U.S. Pat. No. 3,333,762) or channels of a rectangular cross section (U.S. Pat. No. 3,765,792). Sometimes, for practical reasons, channels are made in two half-rings sandwiched together in the parting plane perpendicular to the axis of the ring (U.S. Pat. No 4,012,166). In all the afore mentioned cases inter-channel walls are permanently connected to the side walls of the ring and the leading edges of the inter-channel walls are the result of penetration of surfaces which form the channels. In the case of a channel having a circular cross section the leading edges of inter-channel walls have an elliptical shape and in the case of a channel with a rectangular cross section the leading edges are straight lines. In diffusers with the elliptical leading edges, the inter-channel wall on the side of the compressor impeller exists in the initial part at the walls only thus forming, so to speak, partial blades, which combine with each other only at some distance from the compressor impeller, thus forming separate channels. In consequence, an extensive zone of pseudovanes is produced, wherein the diffuser acts on the stream of the medium in the vicinity of side walls only, whereas the central portion of the stream is braked with considerable losses in a blade-less diffuser, produced and developed especially in the radial direction with an existing relatively large zone of an ultrasonic flow. In the diffusers with recti-linear leading edges of the walls, at the inlet of the channels there is produced a strong perpendicular shock wave and some zone of ultrasonic flow. The process of passage of the medium through one shock wave isn't efficient enough and the existence of a zone of an ultrasonic flow causes in effect additional losses. The design of diffuser with additional vanes with rectilinear leading edges introduced in the inlet portion of the diffuser known from the U.S. Pat. No. 3,765,792 decreases in effect the area of an ultrasonic flow, but doesn't eliminate the process of braking of flow in one perpendicular shock wave.

SUMMARY OF THE INVENTION

The aim of this invention has been an improvement of efficacy of the compression process, especially in the inlet portion of the diffuser and development of a method facilitating the manufacture of such a diffuser. This aim has been achieved by: Ultrasonic channel diffuser, particularly radial one, consisting of a ring with equally spaced, channels, wherein inter-channel walls, formed by the channels shapes, are connected permanently at least to one side wall of said ring according to the invention, said diffuser being characterised in that, on the inlet side, the inter-channel walls have surfaces convertent towards the compressor impeller in their cross sections by the planes passing through the diffuser axis and are sharply terminated close to the centre of their cross dimension. Also inter-channel walls have, on the side of the channels, the surfaces situated closer to the impeller converging towards the impeller. Moreover, the diffuser ring on the inlet side can have, for practical reasons, removable side walls which can also be provided, in the zone between the diffuser inlet and the throats of the individual channels, with partial vanes with sharp, rectilinear or curvilinear edges. In the case of making the diffuser by casting or injecting, the side walls either having partial vanes, or without any vanes, can be integrated with the diffuser ring.

The method of manufacture of an ultrasonic diffuser, particularly a radial one, wherein inter-channel walls have been formed by the channel shape and have been permanently connected to at least one side of the ring wall according to this invention consists in that the side surface of the inter-channel walls in the inlet portion of the diffuser are made convergent by being cut to the required depth by two rotating counter-profiled surfaces with axes of rotation aligned with the diffuser axis. These surfaces intersect in the vicinity of the leading edge of inter-channel walls close to the line combining the centres of cross dimensions of said walls by planes passing through diffuser axis. Moreover, the surfaces of said iner-channel walls on the side of the diffuser channels situated closer to the impeller are made convergent toward the diffuser axis. What is more, if the diffuser has removable side walls in its initial portion, a recess or cutout is made corresponding to the shape of adjoining surfaces of said removable side walls. Next, in said cutouts or recesses independently made removable side walls are to be mounted both those provided with partial vanes, as well as those without any vanes made according to this invention.

The diffuser according to this invention enables a system of oblique compression waves and a weak closing perpendicular wave to be produced in the flowing stream of the medium in the case of an ultrasonic flow, which considerably improves efficiency of the compression process. This compression proces initially takes place in the zone of a flow of the medium relatively undisturbed by the boundary layer which, in the case of an inter-channel wall having a sharp edge in the design a tapered pointed central body makes possible the generation of a system of compression waves for the whole zone of utrasonic flow in the inlet portion of the diffuser. Simultaneously, the presented solution minimizes the zone of an inefficient vane-less diffuser. Excellent results are obtained by locating partial vanes with sharp edges in the inlet portion of the diffuser. Said partial vanes located between the diffuser inlet and the channel throats are intended for directing the flow of the medium in the vicinity of the walls in the ultrasonic zone by the surfaces of pseudo-vanes.

The method according to the invention facilitates considerably the manufacture of the diffuser, thus enabling complicated shapes of the inter-channel walls in the inlet portion of the diffuser to be obtained using relatively simple machining operations.

BRIEF DESCRIPTION OF THE DRAWINGS

The inventions will be explained in detail on an example of embodiment of a diffuser shown in the drawing, wherein.

DESCRIPTION OF THE PREFRRED EMBODIMENT

Figure 1:
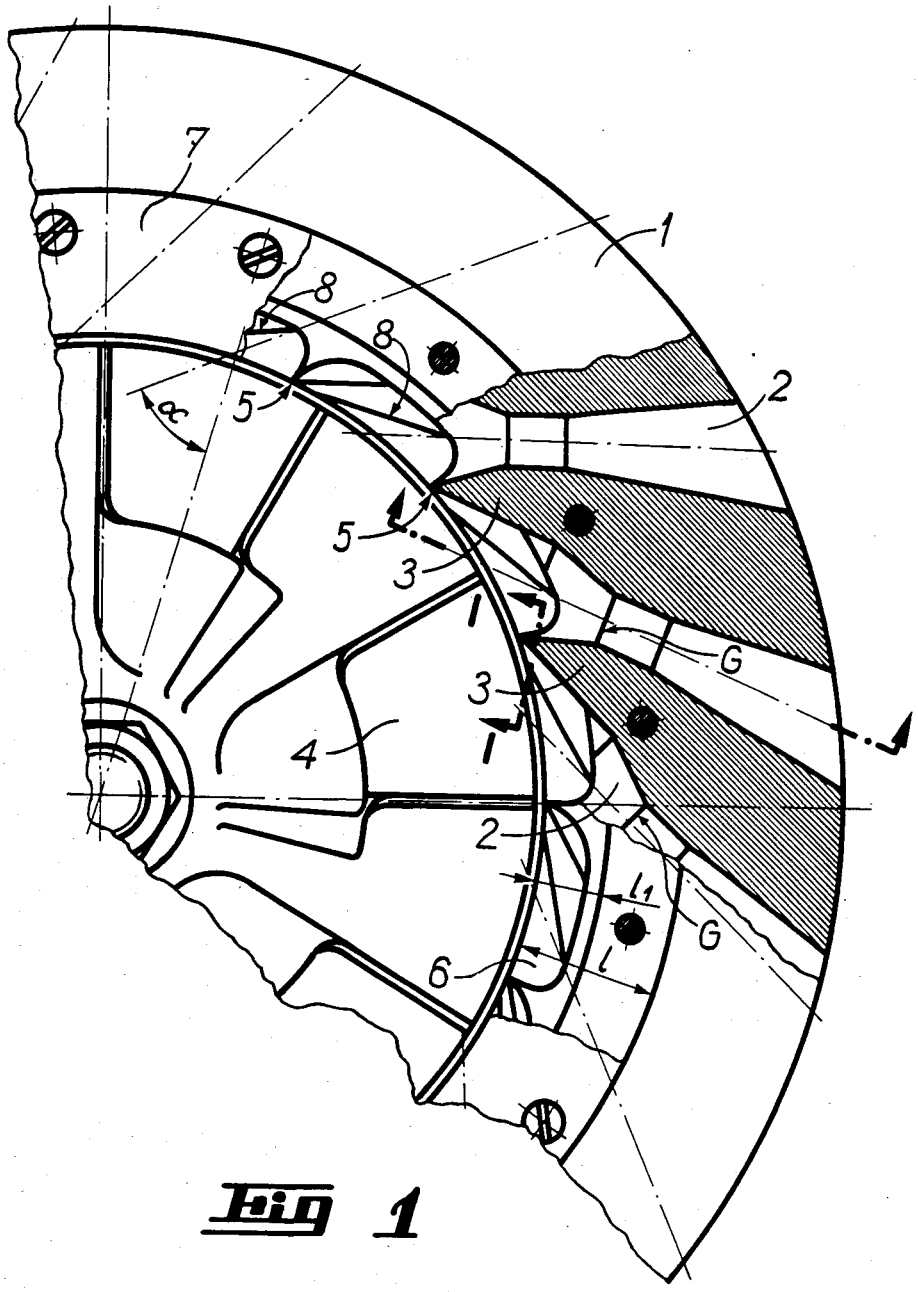
FIG. 1 presents the side view of the diffuser situated on the compressor impeller with cutout sections.
Figure 2:
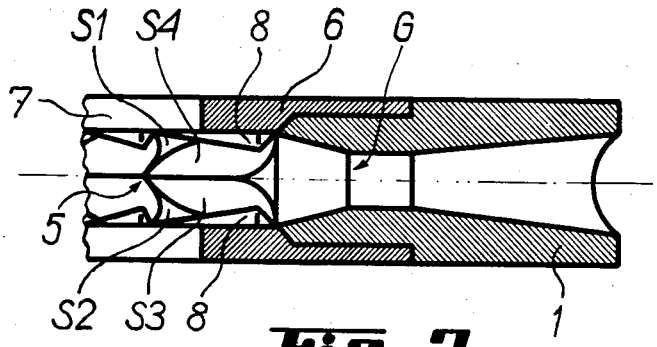
FIG. 2 presents the cross section along the diffuser channel by a plane parallel to the diffuser axis.
Figure 3:
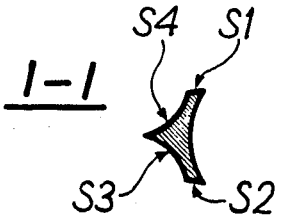
FIG. 3 shows the section through the projecting part of the inter-channel diaphragm along I—I line shown in FIG. 1, and FIG. 4 visualizes the section of the removable side wall with a partial vane.
Figure 4:
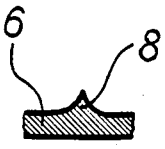

The diffuser consists of a uniform ring 1 with channels 2 situated at angle $\alpha$ relative to the diffuser radius and equally spaced over the circumference. Channels 2 have circular cross sections and they are convergent in the inlet portion with respect to the direction of flow of the medium and divergent in the outlet portion with a cylindrical zone of an appropriate length in the middle portion. Inter-channel walls 3 formed by the shape of the channels 2 have, on the inlet side of the diffuser, surfaces S1, S2 and S3, S4 convergent towards the compressor impeller 4 and each of them is terminated with an edge 5 in the mid-thickness of its cross dimension in a plane passing through the diffuser axis. Moreover, the diffuser, on the inlet side, has removable side walls 6 and 7 mounted over an appropriate length l, said side walls being provided with partial vanes situated between the diffuser axis and the throats G of the individual channels 2.

The method of manufacture of the described diffuser consists in that suitable cutouts S1 and S2 are made on the side surfaces of the initial cylinder of the ring 1 to depth $l_1$ on the side of the inside diameter of the diffuser by two conical planes co-axial with the diffuser axis, with apices directed to each other and intersecting in the mid-thickness of the ring 1, thus obtaining a line combining the centres of their cross dimensions and forming an edge 5. Simultaneously with the cutouts S1 and S2 a recess is made corresponding to the dimensions of independent removable side walls 6 and 7. Next, appropriately shaped channels 2 are made equally spaced over the external circumference of the ring 1 in a plane perpendicular to its axis and passing through its mid-thickness which is equivalent with passing through its edge 5, said channels being inclined at angle $\alpha$ with respect to the diffuser. The inter-channel walls 3 thus obtained are profiled with conical surfaces S3 and S4 with axes inclined with respect to the axis of the channel 2, the inclination of said axes being convergent in the direction of flow of the medium. As a result of these operations the final shape of the wall 3 is obtained acting in the inlet portion of the diffuser as a sharply terminated central body situated in the stream of the flowing medium, and thus producing compression waves during the operation of the diffuser. Next, independently made side walls 6 and 7 provided with partial vanes 8 are to be mounted in the recesses l of the ring 1.

We claim:

1. A supersonic channel diffuser, particularly a radial one, comprising an impeller rotatable about a diffuser axis, and a ring with equally spaced channels surrounding the impeller, wherein inter-channel walls, defined by the shape of the channels, are permanently connected to at least one side wall of the ring, the improvements being characterized in that, on the inlet side of the diffuser, the inter-channel walls, in cross-sections defined by planes passing through the diffuser axis, have a pair of surfaces which are convergent towards the impeller and are terminated with sharp edges close to the center of said cross-sections, and said inter-channel walls have a second pair of surfaces, formed from a side of each of the channels, situated closer to the impeller, which are convergent towards the impeller.

2. The diffuser of claim 1, wherein said channels have two side walls in the zone between the outlet from the impeller and throats formed in each individual channel, said side walls being formed with partial vanes having sharp edges which are curvilinear.

3. The diffuser of claim 1, wherein from the inlet side of the diffuser there are removable side walls.

* * * * *